US006702902B1

(12) United States Patent
Fulconis et al.

(10) Patent No.: US 6,702,902 B1
(45) Date of Patent: Mar. 9, 2004

(54) METHOD AND DEVICE FOR RADIOACTIVE DECONTAMINATION OF A STEEL WALL

(75) Inventors: Jean-Michel Fulconis, Roquemaure (FR); Jacques Delagrange, St Paulet de caisson (FR); Francis Dalard, Meylan (FR)

(73) Assignee: Commissariat a l'Energie Atomique, Pairs (FR)

( * ) Notice: Subject to any disclaimer, the term of this patent is extended or adjusted under 35 U.S.C. 154(b) by 0 days.

(21) Appl. No.: 09/959,041

(22) PCT Filed: Apr. 25, 2000

(86) PCT No.: PCT/FR00/01078

§ 371 (c)(1),
(2), (4) Date: Oct. 16, 2001

(87) PCT Pub. No.: WO00/65606

PCT Pub. Date: Nov. 2, 2000

(30) Foreign Application Priority Data

Apr. 26, 1999 (FR) ..... 99 05257

(51) Int. Cl.[7] ..... C23G 1/02

(52) U.S. Cl. ..... 134/3; 134/28; 134/34; 134/37; 134/41; 376/308; 376/309; 376/310

(58) Field of Search ..... 134/2, 3, 28, 34, 134/37, 41; 376/308, 309, 310

(56) References Cited

U.S. PATENT DOCUMENTS 4,162,229 A * 7/1979 Loewenschuss ..... 376/310
4,217,192 A * 8/1980 Lerch et al. ..... 205/742
4,663,085 A * 5/1987 Enda et al. ..... 204/235
4,704,235 A * 11/1987 Arvesen ..... 376/310
5,073,333 A * 12/1991 Arvesen ..... 376/310
5,545,794 A * 8/1996 Bray ..... 588/1
6,147,274 A * 11/2000 Wood et al. ..... 588/1

FOREIGN PATENT DOCUMENTS

| | | |
|---|---|---|
| FR | 2 701 155 | 2/1993 |
| WO | 85/04279 | 9/1985 |
| WO | 90/01774 | 2/1990 |
| WO | 99/43006 | 8/1999 |

OTHER PUBLICATIONS

Japanese Abstract for 59–220698; Database WPI; Derwent Publications Ltd., London, GB; XP002103265; Dec. 1984; 1 page.

* cited by examiner

*Primary Examiner*—Randy Gulakowski
*Assistant Examiner*—M. Kornakov
(74) *Attorney, Agent, or Firm*—Pearne & Gordon LLP

(57) ABSTRACT

Disclosed a method for radioactive decontamination of a steel surface, which is performed by bringing the surface to be decontaminated into contact with a pickling solution comprising a first iron oxidation agent, wherein bringing into contact being achieved by means of the direct continuous introduction into the pickling solution of a gas comprising a second oxidation agent, and a device for implementing the said method.

9 Claims, 2 Drawing Sheets

METHOD AND DEVICE FOR RADIOACTIVE DECONTAMINATION OF A STEEL WALL

BACKGROUND ART

The present invention relates to a method for the radioactive decontamination of a steel surface, and particularly to a method for the radioactive decontamination of a steel surface using pickling. The invention relates, for example, to the radioactive decontamination of an internal circuit, a metal surface, piping or item of equipment in a reprocessing plant for irradiated nuclear fuel, hereinafter referred to as the "surface". The invention relates particularly to the radioactive decontamination of a surface made of austenitic steel, which is used to construct most surfaces of such plants.

The present invention also relates to a device for implementing the said method.

The radioactive contamination fixed on the surfaces of reprocessing plants is mainly due to surface adsorption. This contamination includes metastable radioactive contamination composed of $Pu^{241}$, Am, U, $^{242, 244}Cm$, $^{137}Cs$, $^{90}Sr$ and particulate radioactive contamination with ruthenium and the following insoluble compounds: cesium phosphomolybdate, zirconium phosphate, zirconium molybdate, plutonium phosphate mixed molybdate of zirconium and plutonium, oxides of Mo, Sb, Al, Fe, colloidal plutonium oxides, etc.

It is therefore unnecessary to cause significant erosion to decontaminate the surfaces. It is generally accepted that, depending on the surface, erosion of the order of between 2 and 10 $\mu$m is sufficient.

Generally speaking, and particularly in the above example of decontamination of a reprocessing plant for irradiated nuclear fuel, radioactive decontamination may involve two major stages:

- a first stage aimed at eliminating metastable contamination and the main deposits adhering to the surfaces, and
- a second stage aimed at eliminating both particulate contamination fixed on the surfaces and residual deposits.

The first stage is a rinsing stage using a variety of sequences of rinsing that are non-corrosive for the surface; the second state is an erosive stage that uses reagents that are corrosive for the surface and mainly consist of oxidizing mixtures such as nitric acid/fluorhydric acid, nitric acid/cerium IV nitrate, or mixtures comprising chromic acid, nitric acid and cerium nitrate.

The nitric acid/fluorhydric acid mixture has the advantage of attacking refractory contamination deposits such as a variety of molybdates or phosphates such as $Zr^{4+}$, $MoO_2^{2+}$, $Pu^{4+}$ and antimony oxides.

During the corrosion stage the best decontamination factors are generally achieved when erosion is both slow, i.e. at a kinetic rate of the order of 1 $\mu$m/h or less, and regular. This is fairly difficult to achieve when the circuits to be decontaminated are complex and have zones that are more sensitive to, corrosion such as, for example, weld zones, zones of mechanical stress, etc.

Furthermore, the oxidant used for the corrosion must not be too harsh. This is why the oxidant mixture of nitric acid/fluorhydric acid cannot always be used as it is difficult to control, particularly on large extended surfaces.

Furthermore, some surfaces of the internal circuits of reprocessing plants for irradiated nuclear fuels are made of austenitic steel. It is therefore necessary on these surfaces to use an oxidant that does not cause intergranular corrosion of the steel. The oxidation-reduction couple of $Ce^{IV}/Ce^{III}$ is one of the rare oxidant agents that can be used to produce a given degree of erosion on austenitic steel surfaces without causing excessive intergranular corrosion.

However, the methods of the prior art using the above oxidation-reduction couple have the particular drawback of requiring, as a precondition of effective decontamination, large quantities of cerium (of the order 0.5 mole/$m^2/\mu m^{-1}$) and hence raising the price of effluent treatment as high concentrations of cerium are not authorized in the vitreous containment matrices. The concentration of cerium required in these methods is therefore a limiting factor.

In the methods of the prior art, the concentration of $Ce^{IV}$ drops throughout the reaction, implying changing kinetics of corrosion: corrosion is too strong at the beginning and too weak at the end. This drawback is overcome by the present invention since the concentration of $Ce^{IV}$, and therefore the kinetics, is virtually constant.

In addition, the methods of the prior art, in particular the method described in the above-mentioned document, are designed to treat oxides and not the metal surfaces of valency 0 such as austenitic steel surfaces. The nature of the alloy to be eroded or corroded which, in a reprocessing plant is exclusively austenitic steel and not INCONEL™ or INCOLOY™ or similar means that the presence of chromic acid in the decontaminating solutions of the methods described for the latter is undesirable.

For example, patent application EP-A-0 174 317 discloses a method for decontaminating chrome oxides on the surface of INCONEL™ steam generators in power plants. In this patent the $Ce^{IV}$ used as an oxidation agent is used as an agent for regenerating Cerium IV from the Cerium III formed during oxidation. The method discloses the use as a corrosion fluid of an aqueous solution of nitric acid, chromic acid and Cerium nitrate in which ozone has been dissolved. It also uses a gas-liquid contactor to put the ozone into solution.

In the decontamination of a steam generator according to the method disclosed in EP-0 174 317, a regeneration chamber for Cerium IV is coupled with the steam generator, said chamber regenerating the Cerium IV by injecting ozone to saturation point. This cannot be envisaged in a reprocessing plant due to the high $\alpha$, $\beta$ and $\gamma$ radiochemical activity of the components to be decontaminated and the great complexity and variety of components to be decontaminated.

Furthermore, the method disclosed in application EP-0 174 317 reduces without eliminating the variability in corrosion speed by virtue of its direct dependence on the value of the concentration of Cerium IV which changes during the course of the reaction since Cerium IV is regenerated in batches.

DISCLOSURE OF THE INVENTION

The present invention overcomes the drawbacks described above by providing a method for the decontamination of a steel surface consisting in bringing the surface to be decontaminated into contact with a pickling solution comprising nitric acid and a first iron oxidation agent at a suitable temperature such that the face of the said surface is eroded by the oxidation of the metallic constituents such as Fe0, Cr0, Ni0, Mn0 it contains, said bringing into contact being achieved by means of the direct, continuous introduction into the pickling solution of a gas comprising a second oxidation agent such as continuously to oxidize, at least partly, said first oxidation agent reduced by the oxidation of the metallic constituents of the steel.

During the course of the method of the invention the first agent for oxidizing the metallic constituents of the steel is reduced when it oxidizes the metallic constituents of the steel surface and it is continuously regenerated by the second oxidation agent, by oxidation. The first oxidation agent is therefore selected such as to be capable of oxidizing the metallic constituents of the steel surface and the second oxidation agent is selected as being capable of oxidizing the first oxidation agent reduced by oxidation of the metallic constituents of the steel to regenerate it.

The first oxidation agent may, for example, be selected from $Ce^{IV}$, Ag2+, etc.

The gas constituting the second oxidation agent may be selected from gases comprising ozone.

Advantageously, according to one embodiment of the method of the present invention, the first oxidizing agent may be cerium IV, for example as cerium IV nitrate, and the second oxidizing agent may be a gas including ozone.

According to this embodiment, the present invention makes it possible in particular to eliminate the above drawbacks relating in particular to the methods of the prior art using cerium.

The present invention proposes means for continuously regenerating cerium IV throughout the reaction at a constant speed. Throughout the reaction the concentration of cerium IV is thus constantly at the optimal value for decontamination. The present invention discloses a method by which a second oxidizing agent, for example ozone, is dissolved in the pickling solution (also referred to below as the decontamination solution) directly in the component to be decontaminated. Furthermore, the method disclosed in the present invention makes it possible to solubilize the second oxidizing agent, for example ozone, in the pickling or decontamination solution without making any modification or adding any special fittings to the installation to be decontaminated.

According to the invention the pickling solution may be an aqueous solution containing nitric acid at a concentration of approximately 0.5 to 5 $mol.1^{-1}$ and cerium nitrate at a concentration of approximately 0.001 to 0.1 $mol.1^{-1}$.

According to the invention the gas including ozone may also include at least one gas selected from either oxygen and nitrogen.

According to the invention the gas including ozone may include approximately 1 to 20% ozone.

According to the invention the appropriate temperature may be approximately 10 to 80° C., for example ambient temperature, for example 25° C.

According to the invention the steel surface may be a surface of an internal circuit of a reprocessing plant for irradiated nuclear fuel, for example a surface made of austenitic steel.

The ozone introduced into the pickling solution may, for example, be dissolved in the solution by using two modifications of a component that is very common in reprocessing installations and usually used to initiate movement in liquid solutions. In the application of the method of the present invention the introduction of ozone into the erosion solution may be achieved using two gas-liquid contact components that may either be transfer air-lifts, of either the naturally submerging or vacuum submerging type, and/or air-lift agitators. However, in the absence of these two systems the invention may be embodied by injecting gas by means of any type of submersible piping for introducing a liquid or gaseous reagent. By virtue of their use as disclosed in the present invention the said devices play a dual role during decontamination:

by performing the agitating function they ensure continuous renewal of the liquid-solid interface at which the oxidation stages of the metal support and dissolution of oxidized species occur, by providing close gas-liquid contact they ensure transfer of the second oxidizing agent, for example ozone, into the pickling solution at the threshold of which the regeneration stage of cerium IV occurs.

According to the method of the invention, by introducing or injecting gas containing the second oxidizing agent, for example ozone, via the two air-lift systems into the decontamination solution, or pickling solution, the gas, for example ozone, plays a dual role:

it is used as a power source for hydrodynamic agitation, it adds the second oxidizing agent, for example ozone, which is necessary for the regeneration of cerium IV, to the solution.

The present invention also provides a device for the radioactive decontamination of a steel surface of an internal circuit of a reprocessing plant for irradiated nuclear fuel according to the method of the present invention, said internal circuit being provided with an agitator and/or transfer air-lift, a device, in which the air-lift is used both as a means for introducing the gas containing the second oxidizing agent into the pickling solution containing the first oxidizing agent, and as a means for homogenizing the pickling solution when the said solution is brought into contact with the steel surface to be decontaminated.

According to the invention the device may, also include an assembly for producing the second oxidizing agent, for example when the first oxidizing agent is cerium IV the second oxidizing agent may be ozone and the said production assembly may therefore be an assembly for producing ozone. This assembly may be a standard type of assembly known to those skilled in the art for the production of ozone.

The fact that the present invention uses two different types of air-lift, the method makes it possible to select accurately and simply what portion of an installation is to be decontaminated.

Other and advantages of the present invention will emerge,from the following description of non-limitative examples given with reference to the attached figures.

The advantages, of the method of the present invention are many:

Because ozone is injected remotely into the component being decontaminated, the method is completely independent and therefore no action is required on the decontaminating solution acting on a "process" component. Control of the method is limited to possible analytical monitoring of the concentration of corrosion elements; this may be done by using existing sampling systems to take samples of the pickling solution.

In practical terms, given the low quantities of ozone required, the ozone production system is very small in size, it is light and may easily be mounted on a movable support. The ozone production system is supplied either from the compressed air available in the installation, in which case it may be necessary to provide devices for de-oiling and drying the compressed air, or using a cylinder of reconstituted air, or again pure oxygen. The device must be fitted with means for monitoring the concentration of ozone output by the ozone generator in order to control the proper progress of the CeIV regeneration procedure.

Figure 1:
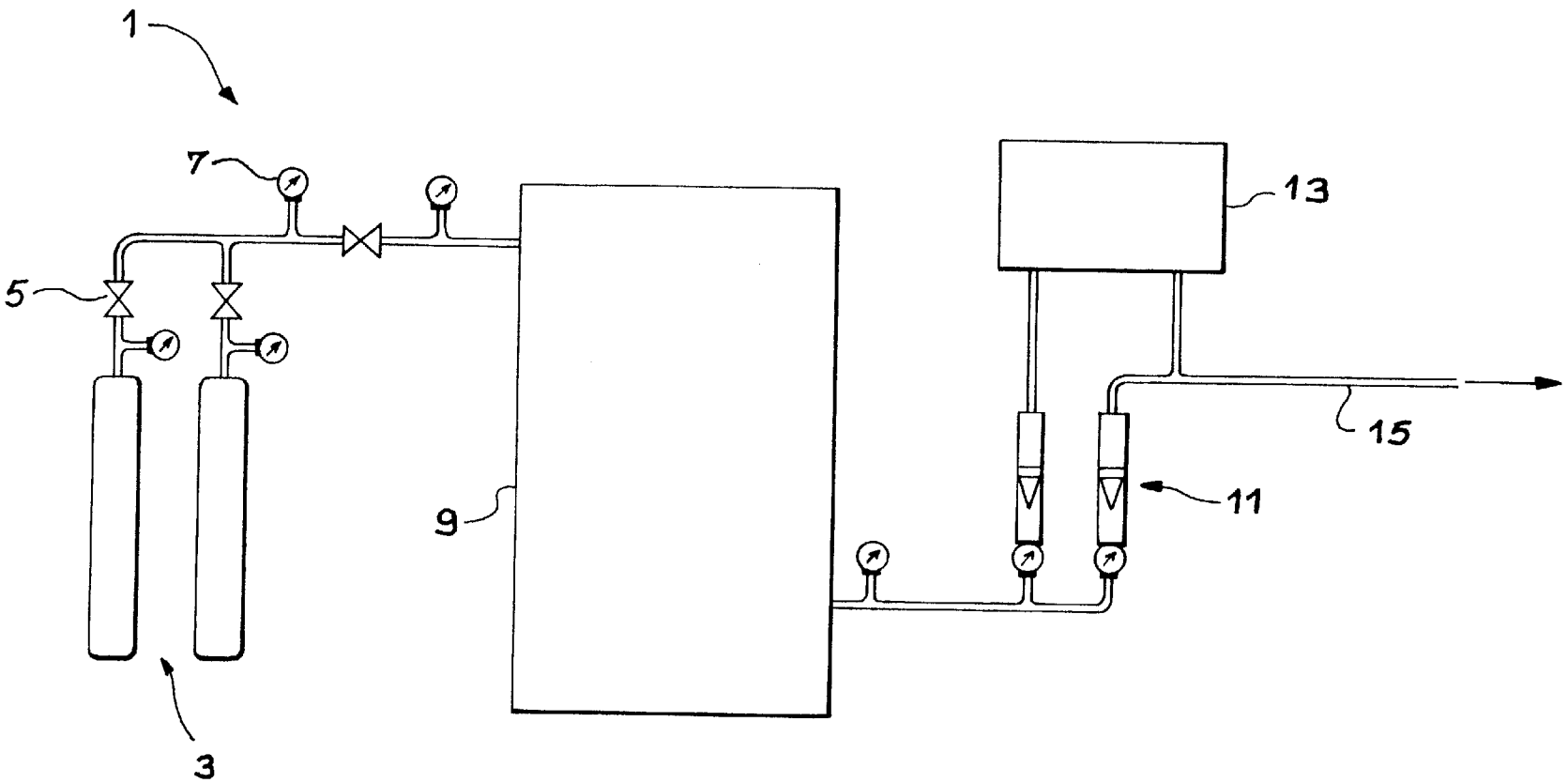
FIG. 1 is an example of an embodiment of an assembly for producing and monitoring the concentration of ozone in the method of the invention.

The attached diagram of FIG. 1 shows an assembly for producing and monitoring concentrations of ozone in the gaseous mixture injected into the pickling solution contained in the component to be decontaminated. In this figure reference 1 is an ozone production device, FIG. 3 a supply of oxygen or reconstituted air, reference 5 the control valves, reference 7 control pressure gauges, reference 9 a standard ozone generator, reference 11 means for adjusting the flow-rate of gas injected, reference 13 an analyzer and reference 15 a pipe feeding gas containing ozone into the pickling solution contained in the component to be decontaminated. The same ozone production device may thus be used successively for all the components to be decontaminated.

The fact of injecting directly using existing piping means that the direction in which the fluids flow remains within the containment barriers already present in the method. Since the ozone production device is in overpressure relative to the component to be decontaminated, there is no risk of the containment barriers being breached. The excess ozone immediately passes into the existing venting circuits. Given the low mass flow of ozone and the dilution by the ventilation system, the method requires no device for neutralizing the excess ozone.

Chemical Aspects of the Method of the Invention

An overview of the chemical reactions in play may be written as follows:

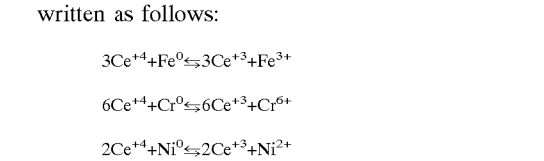

$$3Ce^{+4}+Fe^{0}\leftrightarrows 3Ce^{+3}+Fe^{3+}$$

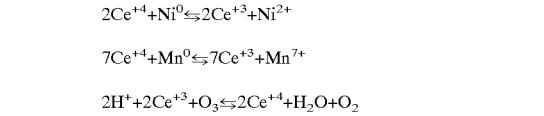

$$6Ce^{+4}+Cr^{0}\leftrightarrows 6Ce^{+3}+Cr^{6+}$$

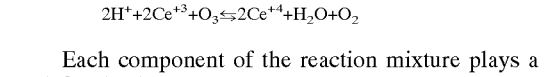

$$2Ce^{+4}+Ni^{0}\leftrightarrows 2Ce^{+3}+Ni^{2+}$$

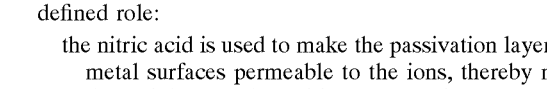

$$7Ce^{+4}+Mn^{0}\leftrightarrows 7Ce^{+3}+Mn^{7+}$$

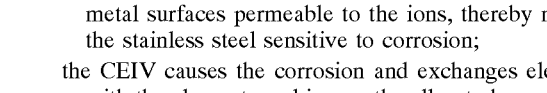

$$2H^{+}+2Ce^{+3}+O_3\leftrightarrows 2Ce^{+4}+H_2O+O_2$$

Each component of the reaction mixture plays a clearly defined role:

- the nitric acid is used to make the passivation layer of the metal surfaces permeable to the ions, thereby making the stainless steel sensitive to corrosion;
- the CEIV causes the corrosion and exchanges electrons with the elements making up the alloy to be corroded;
- the ozone is the agent of regeneration of the CeIV since the oxidation-reduction potential of the couple O3, $H^{+}/H_2O$, $O_2$ is greater than that of the couple $Ce^{IV}/Ce^{III}$: 2.075 V/ENH compared with 1.72 V/ENH.

A key parameter in controlling corrosion speed is the concentration of CeIV. Thus, depending on the thickness of corrosion required, which depends on the depth of contamination (usually somewhere between 2 and 10 $\mu$m) and the ratio between the surface and the volume of the circuit in question, the initial concentration of CeIV will be selected to optimize both the corrosion speed and the duration of the operation. The present invention therefore makes it possible to control the concentration of CeIV by in situ oxidation of the CeIII formed during corrosion by ozone dissolved in the pickling solution by bubbling.

Using a given total cerium nitrate concentration, the equilibrium between $Ce^{IV}$ and $Ce^{III}$ is reached as soon as the $Ce^{IV}$ consumption and production speeds are stationary; the lower the quantity of cerium, the faster this stationary status is reached. Under the implementation conditions of, the invention, given the small quantities of cerium used the stationary state is rapidly reached; moreover, the equilibrium achieved tends strongly towards the valency IV of cerium which is significantly in the majority (over 90%) compared with cerium III. The use of the cerium introduced is thus optimal as virtually all the cerium introduced is permanently in usable form. In order for this condition to be met, a slight excess of ozone must be produced.

The regeneration reaction of $Ce^{IV}$ by ozone from $Ce^{III}$ is written:

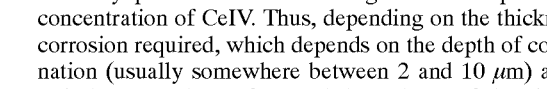

$$O_3+2H^{+}+2e^{-}\leftrightarrows O_2+H_2O$$

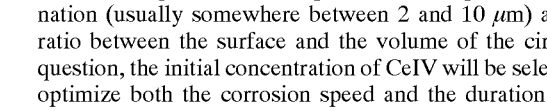

$$2Ce^{+3}\leftrightarrows 2Ce^{4+}+2e^{-}$$

or:

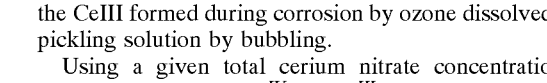

$$O_3+2H^{+}+2Ce^{+3}\rightarrow O_2+H_2O+2Ce^{4+}$$

The speed at which $Ce^{IV}$ is regenerated from $Ce^{III}$ is dependent on a large number of parameters. The process may be expressed using a standard Arrhenius equation of the type:

$$d[Ce^{IV}]/dt=A_{app}\exp(-E_{app}/RT)[O_{3dissolved}]^{a}[Ce^{III}]^{b}$$

where:

- $A_{app}$ and $E_{app}$ are respectively the pre-exponential factor and the Arrhenius activation energy of the reaction. These magnitudes are described as apparent because in the present situation they are dependent on a number of factor such as acidity,
- R the ideal gas constant,
- T the thermodynamic temperature,
- $[O_{3dissolved}]$ the ozone concentration in the solution,
- a the order of the reaction relative to the concentration of dissolved ozone,
- $[Ce^{III}]$ the concentration of cerium at valency III,
- b the order of the reaction relative to the concentration of cerium at valency III.

If the temperature and acidity of the medium are set, the regeneration speed of CeIV is dictated by the concentration of ozone dissolved in the solution. This concentration is only constant when the solution is saturated with ozone.

The speed at which the decontaminant solution becomes saturated with ozone is dependent upon a number of factors such as the acidity of the medium, the temperature or the contactor mode used. It should be noted that under the operating conditions of the method of the invention and in the absence of any ozone-consuming reaction, the ozone concentration stabilizes after a few minutes (ten minutes at most). The speed at which ozone changes to its liquid phase does not therefore constitute a limiting factor for the regeneration speed of CeIV.

The concentration of ozone in equilibrium with a nitric solution is dependent upon a number of parameters, for example temperature (solubility diminishes with temperature), concentration of nitric acid (solubility diminishes slightly with nitric acid content). Tables I and II below give several values measured under operating conditions of the method of the invention.

TABLE I

| $[O_3]_{dissolved}$ as a function of temperature $0.5 < HNO_3 < 4$ mol · $1^{-1}$, $[O_3]_{gas} = 35$ g · $m^{-3}$ | |
|---|---|
| θ/° C. | $[O_3]_{dissolved}$/mg · $1^{-1}$ |
| 20 | 8.5 |
| 30 | 7.7 |
| 40 | 6.3 |

TABLE II

| $[O_3]_{dissolved}$ as a function of $[O_3]_{gas}$ $0.5 < HNO_3 <$ mol · $1^{-1}$, θ = 20°°C. | |
|---|---|
| $[O_3]_{gas}$ g · $m^{-3}$ | $[O_3]_{dissolved}$/mg · $1^{-1}$ |
| 27 | 6.3 |
| 38 | 8.9 |
| 46 | 11.5 |

The method described in the present invention can be used to control each of the following parameters:

temperature between 10 and 50° C. for example, ambient temperature, for example approximately 25° C., acidity between 0.5 and 4 mol.$1^{-1}$, for example $HNO_3$ 4 mol.$1^{-1}$, initial concentration of cerium between for example $1.10^{-3}$ and $10^{-1}$ mol.$1^{-1}$, for example $10^{-2}$ mol.$1^{-1}$, flow-rate of ozonized gas suitable for the component to be decontaminated and the type of contactor, concentration of ozone in the gas, for example between 1 and 20% by weight.

For example, the concentration of dissolved ozone may vary between 1 and 20mg.$1^{-1}$.

By using just enough cerium to give suitable kinematics, the residual corrosion when the operation ends is reduced; stopping injection of ozone causes virtual immediate stoppage of the regeneration of CeIV and the rapid stoppage of corrosion by virtue of the small quantity of CeIV present in the medium. Moreover, since the quantity of CeIV present on stoppage of ozone injection is low and known as such, it is very easy to monitor final corrosion. The corrosion, speed may thus be controlled making analytical monitoring easier to set up using the set of samples and regular analyses of samples of the corrosion solution.

Figure 2:
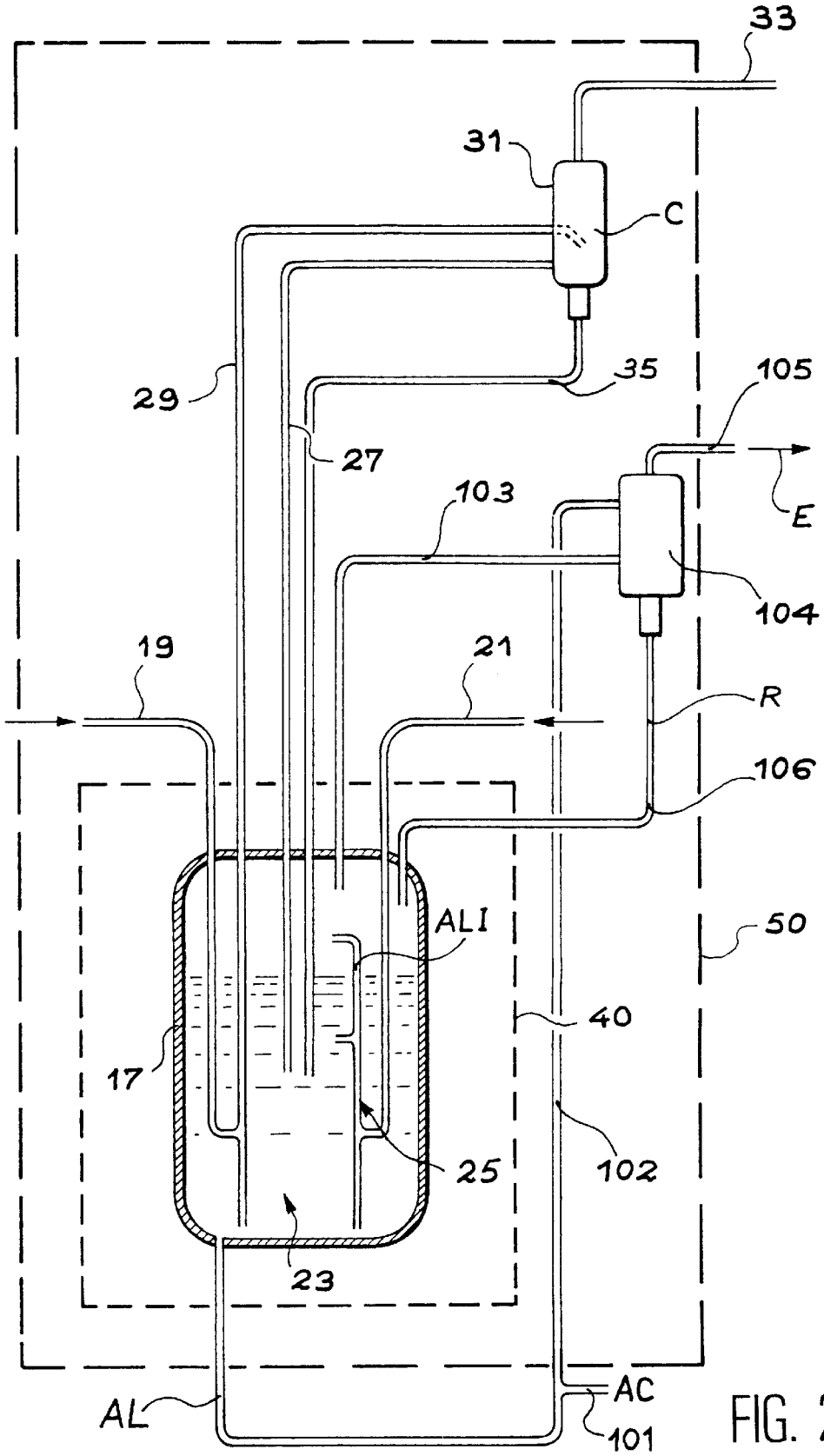
FIG. 2 is a diagram showing the method of the present invention as applied to a tank in a reprocessing plant for irradiated nuclear fuel.

FIG. 2 attached is a diagram showing the method of the present invention as applied to a tank in a reprocessing plant for irradiated nuclear fuel. In this figure, reference 17 is the surface to be decontaminated, references 19, 21 and 101 are pipes supplying ozonized air or oxygen, reference AC is a supply of compressed air of air-lift 102, reference AL is a natural AL circuit and relates to a naturally submerging airlift (see reference 102), reference 23 is the pickling solution of the invention, reference 25 a prioritized area for the solubilization of ozone, references 29 and 102 are other prioritized areas for the solubilization of ozone, references 27 and 103 the overflow pipes of the sealing pots, references 31 and 104 a sealing pot, reference 33 a vacuum generating circuit, reference 105 a venting circuit, references 35 and 106 the piping for returning regenerated solutions to the tank to be decontaminated, reference C a circuit under negative pressure, reference ALI a submerged air-lift agitator, reference R a return to the initial tank and reference E the outlet to the vent. In this figure the dotted line numbered 40 shows decontamination limited to the surfaces of the tank and its fittings while dotted line 50 shows the decontamination of all the surfaces of the circuit comprising the tank and associated fittings such as the piping of the transfer components and the sealing pots.

The compressed air supply AC may also be used for injecting a gas or gaseous mixture. It performs the same functions as those of the components reference 19 and 21.

The present invention is capable of using three types of air-lift:

a vacuum air-lift, a submerged air-lift;

a naturally submerged air-lift.

EXAMPLES

Table III below shows examples of changes in the thickness of steel corroded as a function of the concentration of CeIV after 12 hours during corrosion of a test-piece of 604L stainless steel with a Surface/Volume ratio of 10: $HNO_3$ 4 mol.$1^{-1}$, ozone flow-rate ($d_{03}$)=6 g.$h^{-1}$, volume of solution 3 liters.

TABLE III

| Thickness of 604 L corroded in 12 hours as a function of [CeIV] $HNO_3$ 4 mol · $1^{-1}$, $d_{O3} = 6$ g · $h^{-1}$, v = 3 l | |
|---|---|
| [CeIV]/mol · $1^{-1}$ | e/μm |
| $5 \cdot 10^{-2}$ | 13.2 |
| $2 \cdot 10^{-2}$ | 8.6 |
| $1 \cdot 10^{-2}$ | 4.0 |
| $5 \cdot 10^{-3}$ | 0.7 |

As a comparison, table IV below shows the quantity of cerium required to decontaminate 1 $m^2$ of surface (S/V ratio=10) depending on the depth of corrosion required for both the conventional method using cerium alone or the method disclosed in the present invention.

TABLE IV

| Comparison of quantities of cerium required to decontaminate 1 $m^2$ of surface (S/V ratio = 10) depending on the depth of corrosion required | | |
|---|---|---|
| Thickness/μm | Conventional method: quantity of cerium/mol | Invention ($HNO_3$ 4 mol · $1^{-1}$, Ce $10^{-2}$ mol · $1^{-1}$) quantity of cerium/mol |
| 1 | 0.5 | 1 |
| 2 | 1 | 1 |
| 3 | 1.5 | 1 |
| 4 | 2 | 1 |
| 5 | 2.5 | 1 |
| 6 | 3 | 1 |
| 8 | 3.5 | 1 |
| 4 | 4 | 1 |
| 9 | 4.5 | 1 |
| 10 | 5 | 1 |

In the conventional method the quantity of cerium required increases with the thickness of steel to be corroded.

The present invention gives, for example, a corrosion speed of 0.5 μm.$h^{-1}$, or 10 μm in 24 hours, using a solution of $1.10^{-2}$ mol.$1^{-1}$ of cerium in nitric acid 4 mol.$1^{-1}$ with bubbled ozonized oxygen.

What is claimed is:

1. Method for the decontamination of a steel surface consisting in bringing the surface to be decontaminated into contact with a pickling solution comprising nitric acid and a first oxidation agent of the metal constituents of the steel surface such that the face of the said surface is eroded by the oxidation of the metallic constituents it contains, wherein said bringing into contact is achieved by direct, continuous introduction into the pickling solution of a gas comprising a second oxidation agent to continuously homogenize and oxidize at least partly said first oxidation agent reduced by the oxidation of the metallic constituents of the surface, wherein the pickling solution is an aqueous solution containing nitric acid at a concentration of approximately 0.5 to 5 $mol.1^{-1}$ and cerium nitrate at a concentration of approximately 0.001 to 0.1 $mol.1^{-1}$, and wherein the contact temperature is maintained in the range of approximately 10 to 80° C.

2. Method of claim 1 wherein the first oxidation agent is cerium nitrate IV and the second oxidation agent is ozone.

3. Method of claim 2 wherein the gas including ozone may also include at least one gas selected from either oxygen and nitrogen.

4. Method of claim 2 wherein the gas including ozone includes approximately 1 to 20% ozone.

5. Method of claim 3 wherein the gas including ozone includes approximately 1 to 20% ozone.

6. Method of any of the foregoing claims 9–13 wherein the steel surface is a surface of an internal circuit of a reprocessing plant for irradiated nuclear fuels.

7. Device for the radioactive decontamination of a steel surface of an internal circuit of a reprocessing plant for irradiated nuclear fuels according to the method of the claim said circuit being provided with an air-lift, a device in which the air-lift is used both as a means for introducing the gas containing the second oxidizing agent into the pickling solution containing the first oxidizing agent, and as a means for homogenizing the pickling solution when the said solution is brought into contact with the steel surface to be decontaminated.

8. Device of claim 7 also comprising an assembly for producing the second oxidizing agent.

9. Device of claim 8 wherein the first oxidizing agent is cerium IV, the assembly for producing the second oxidizing agent being an ozone production assembly.

* * * * *

UNITED STATES PATENT AND TRADEMARK OFFICE

CERTIFICATE OF CORRECTION

PATENT NO. : 6,702,902 B1 
DATED : March 9, 2004
INVENTOR(S) : Jean-Michel Fulconis et al.

It is certified that error appears in the above-identified patent and that said Letters Patent is hereby corrected as shown below:

Column 2,
Line 52, insert:

-- Document FR-A-2 701 155 relates to a method and installation for the decontamination of used light water nuclear reactor vessel heads. The method described comprises bringing the contaminated surfaces into contact with an acid decontamination solution comprising cerium of valency IV in the form of $CE^{4+}$ ions. The device disclosed in this document uses a mechanical agitation system. --

Column 4,
Line 23, please delete "device,", and insert therefor -- device --.

Column 7,
Line 15, please delete "20ººC.",, and insert therefor -- 20ºC. --.

Column 10,
Line 8, after "claim", please insert -- 1 --.

Signed and Sealed this

Seventh Day of September, 2004

JON W. DUDAS
*Director of the United States Patent and Trademark Office*

UNITED STATES PATENT AND TRADEMARK OFFICE

CERTIFICATE OF CORRECTION

PATENT NO. : 6,702,902 B1
DATED : March 9, 2004
INVENTOR(S) : Jean-Michel Fulconis et al.

It is certified that error appears in the above-identified patent and that said Letters Patent is hereby corrected as shown below:

Column 10,
Line 3, delete "claims 9-13", and insert therefore -- claims 1-5 --.

Signed and Sealed this

Fifteenth Day of February, 2005

JON W. DUDAS
*Director of the United States Patent and Trademark Office*